US006189493B1

(12) United States Patent
Gray, Jr.

(10) Patent No.: US 6,189,493 B1
(45) Date of Patent: Feb. 20, 2001

(54) TORQUE BALANCED OPPOSED-PISTON ENGINE

(75) Inventor: Charles L. Gray, Jr., Pinckney, MI (US)

(73) Assignee: The United States of America as represented by the Administrator of the United States Environmental Protection Agency, Washington, DC (US)

( * ) Notice: Under 35 U.S.C. 154(b), the term of this patent shall be extended for 0 days.

(21) Appl. No.: 09/352,825

(22) Filed: Jul. 13, 1999

(51) Int. Cl.[7] ..... F02B 75/24
(52) U.S. Cl. ..... 123/52.4; 123/52.6; 123/59.6
(58) Field of Search ..... 123/52.4, 52.6, 123/59.6, 55.7, 55.5, DIG. 8

(56) References Cited

U.S. PATENT DOCUMENTS 807,048 * 12/1905 Ronan ..... 123/DIG. 8
3,370,429 * 2/1968 Brice ..... 123/DIG. 8
4,167,857 * 9/1979 Nishijima et al. ..... 123/DIG. 8
4,442,805 * 4/1984 Yamakawa ..... 123/DIG. 8
4,607,598 * 8/1986 Kamata ..... 123/55.7
4,715,336 * 12/1987 Schindler et al. ..... 123/55.5
5,758,610 * 6/1998 Park ..... 123/52.4

FOREIGN PATENT DOCUMENTS

825380 * 3/1938 (FR) ..... 123/52.4
584215 * 1/1947 (GB) ..... 234/52.4
861769 * 2/1961 (GB) ..... 123/52.6

* cited by examiner

*Primary Examiner*—Marguerite McMahon
(74) *Attorney, Agent, or Firm*—Lorusso & Loud

(57) ABSTRACT

An internal combustion engine having first and second synchronized subassemblies. The subassemblies are synchronized by a mechanical linkage of their crankshafts to provide identical timing between corresponding pistons in the two subassemblies.

6 Claims, 3 Drawing Sheets

TORQUE BALANCED OPPOSED-PISTON ENGINE

FIELD OF THE INVENTION

The field of the invention is internal-combustion engines for motor vehicles. The invention is a means for small engines or engines of few cylinders to reduce or eliminate the effect of cyclic peak-to-valley torque variations characteristic of such engines, that would otherwise be transmitted to the engine mounts or, if in a vehicle, the vehicle frame, creating unwanted vibration and instability and discouraging the use of such engines in motor vehicles.

BACKGROUND OF THE INVENTION

The growing utilization of automobiles greatly adds to the atmospheric presence of various pollutants including oxides of nitrogen and greenhouse gases such as carbon dioxide.

Internal combustion engines create mechanical work from fuel energy by combusting fuel in a thermodynamic cycle consisting (in part) of compression, ignition, and expansion. The cycle results in the travel of one or more cylindrical pistons back and forth in a cylindrical combustion chamber. Each piston is typically connected to a crankshaft that converts the linear back-and-forth motion of the piston(s) into a unidirectional rotary motion that can be used to power a vehicle. Because torque is produced only during the expansion phase, and in fact torque is absorbed during the compression phase, there are large cyclic fluctuations in torque throughout each cycle.

The cyclic, fluctuating nature of the torque produced on the crankshaft tends to favor engines with many pistons operating at high speeds. During each cycle of each piston, the piston-crankshaft assembly and the cylinder walls bear the force of the expanding combustion products. The force on the connecting rod, which is converted to torque via the crankshaft, can be resolved into a force in the direction of piston travel and a side force acting on the cylinder wall and, hence, on the engine block. These piston and side forces vary greatly during successive portions of the cycle, resulting in large fluctuations that manifest themselves either as cyclic variations in crankshaft torque or as inertial engine movement especially when the torque is taken from the shaft. The inertial movement must be resisted by the engine mounts and is ultimately transmitted to the vehicle. The key concern is the peak-to-valley amplitude of the variation. To some extent, the peak-to-valley variation in crankshaft torque can be minimized by transmitting the power through a flywheel, but inertial engine vibration is still a problem. If multiple cylinders are present, the peak-to-valley variations in both crankshaft torque and inertial engine movement can be reduced by staging and timing the combustion cycle for each piston so that their relative torque production and relative motions in their respective portions of the cycle cancel out much of the variation. The more pistons involved, the smaller the peak-to-valley amplitude of the remaining variation. The problem is exacerbated when operating at low speeds, because any variation that remains has a longer period and is more noticeable. For these reasons, most internal combustion engines used in automobiles have from four to eight pistons and operate at high speeds, typically 800 to 4000 rev/min.

Minimizing the number of pistons in an engine and operation at low speed are very attractive from an efficiency standpoint. Few-cylinder engines are simpler in construction and therefore less expensive than many-cylinder engines. More importantly, they are lighter and smaller than many-cylinder engines, allowing reductions in engine weight and engine compartment size that translate into lower curb weight and better fuel economy. Many hybrid powertrain schemes call for unusually slow engine operation (perhaps 500 rpm or less). However, the prior art does not permit such engines to operate at a low speed and high load factor without invoking the problems discussed above.

Opposed-piston or "boxer" engines have existed for some time. They are mechanically balanced, characterized by pairs of opposed pistons in which each pair is arranged in linear opposition with a crankshaft inbetween, but are not torque balanced. Because the pair is connected, one piston head may be in the expansion stroke while the other is in compression, or both may be in the same phase, but their movement is always synchronized. As long as there is an even number of piston heads, the opposition of each pair theoretically cancels out an inertial vibration. However, because the conventional "boxer" engine is not torque balanced, when power is taken from the shaft there is still a tendency to spin the engine, which must be resisted by the engine mounts and vehicle frame, and any cyclic peak-to-valley torque variation must also be borne by the mounts.

SUMMARY OF THE INVENTION

Accordingly, it is an object of the present invention to provide an engine design preventing cyclic engine-transmitted forces which produce torque variations and inertial variations from being borne by the engine mounts and ultimately transmitted to a vehicle frame.

The engine of the invention includes at least two engine subassemblies each, in turn, including a piston/cylinder set, crankshaft, and means for mechanically linking the crankshafts. The two engine subassemblies are physically connected, either simply bolted together or built together as a single entity. Each engine subassembly is independent except for a connection via a synchronization means, e.g. geared wheels which are connected to their respective crankshafts. The geared wheels of each subassembly are enmeshed together to synchronize the respective crankshafts in counter-rotation and in identical timing. In this manner, pairs of cylinders fire simultaneously.

The two counter-rotating crankshafts each receive torque from their respective piston/cylinder assembly. In the illustrated embodiment, each engine subassembly employs an arrangement of pistons such that the inertial effect of any piston is counteracted by the motion of a linked, identically timed twin piston traveling in the direction opposite that of the first piston.

The two crankshafts may power an electric generator, a fluid power device or other device which could be bolted or otherwise affixed entirely to the engine itself, thus eliminating the unwanted torque effect that could be transmitted to the engine mounts or other parts of the vehicle when taking rotary motion off a shaft. By these means the useful work of a few-cylinder engine (2, 4 or 6 piston/cylinder sets) may be conducted to the vehicle and the torque and inertial variation is dissipated within the engine assembly itself, rather than being transmitting through the engine mounts.

DESCRIPTION OF THE PREFERRED EMBODIMENTS

Figure 1:
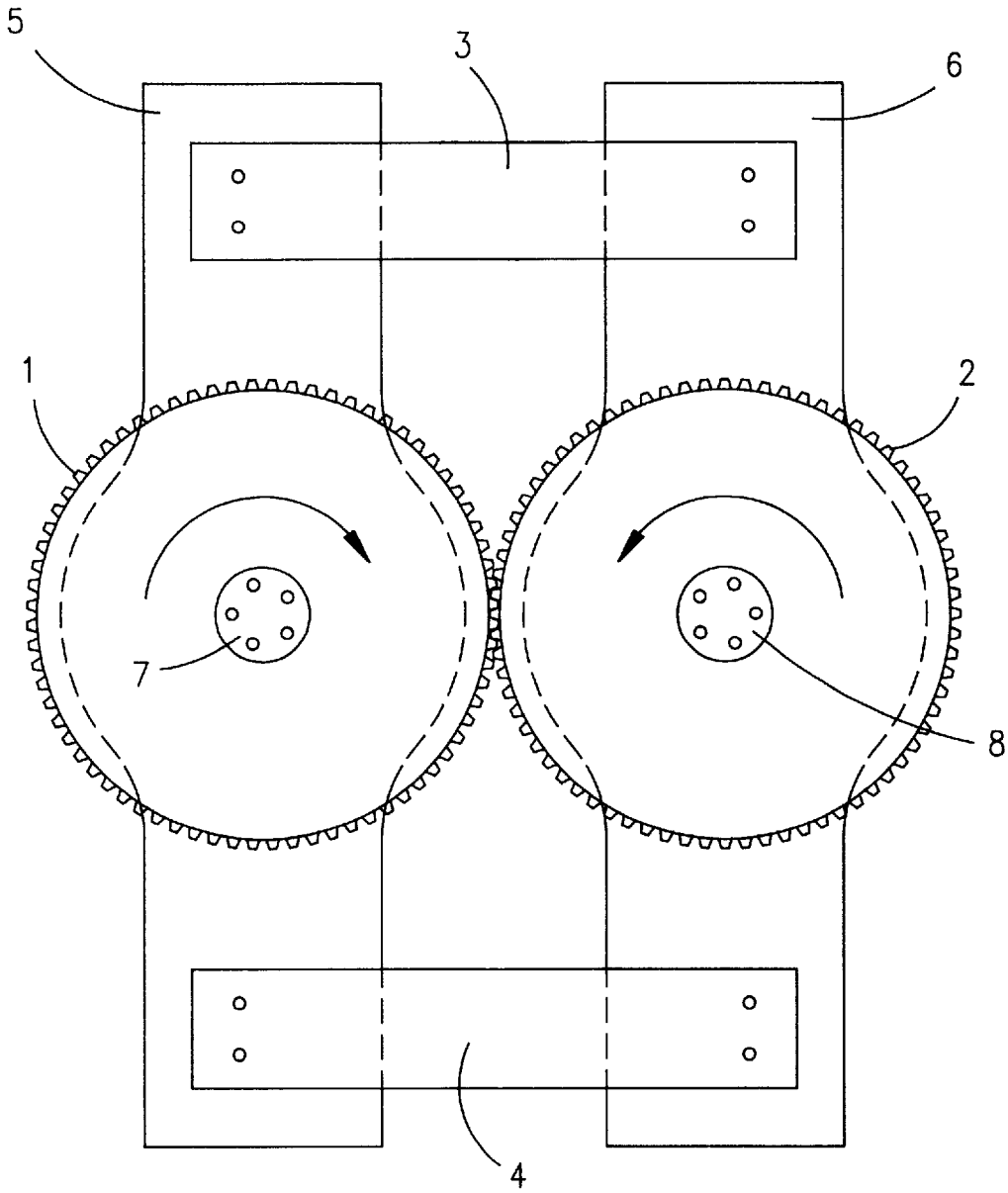
FIG. 1 is a schematic end view of one preferred embodiment of the present invention.

Referring to FIG. 1, the illustrated preferred embodiment includes engine subassemblies 5 and 6 which are either joined as a unit by braces 3 and 4 or otherwise joined together into a single unit. Geared wheels 1 and 2 connect the two engine subassemblies 5, 6 to synchronize the engine subassemblies at a common speed and timing, causing crankshafts 7 and 8 to be synchronized and to rotate in opposite directions.

Figure 2:
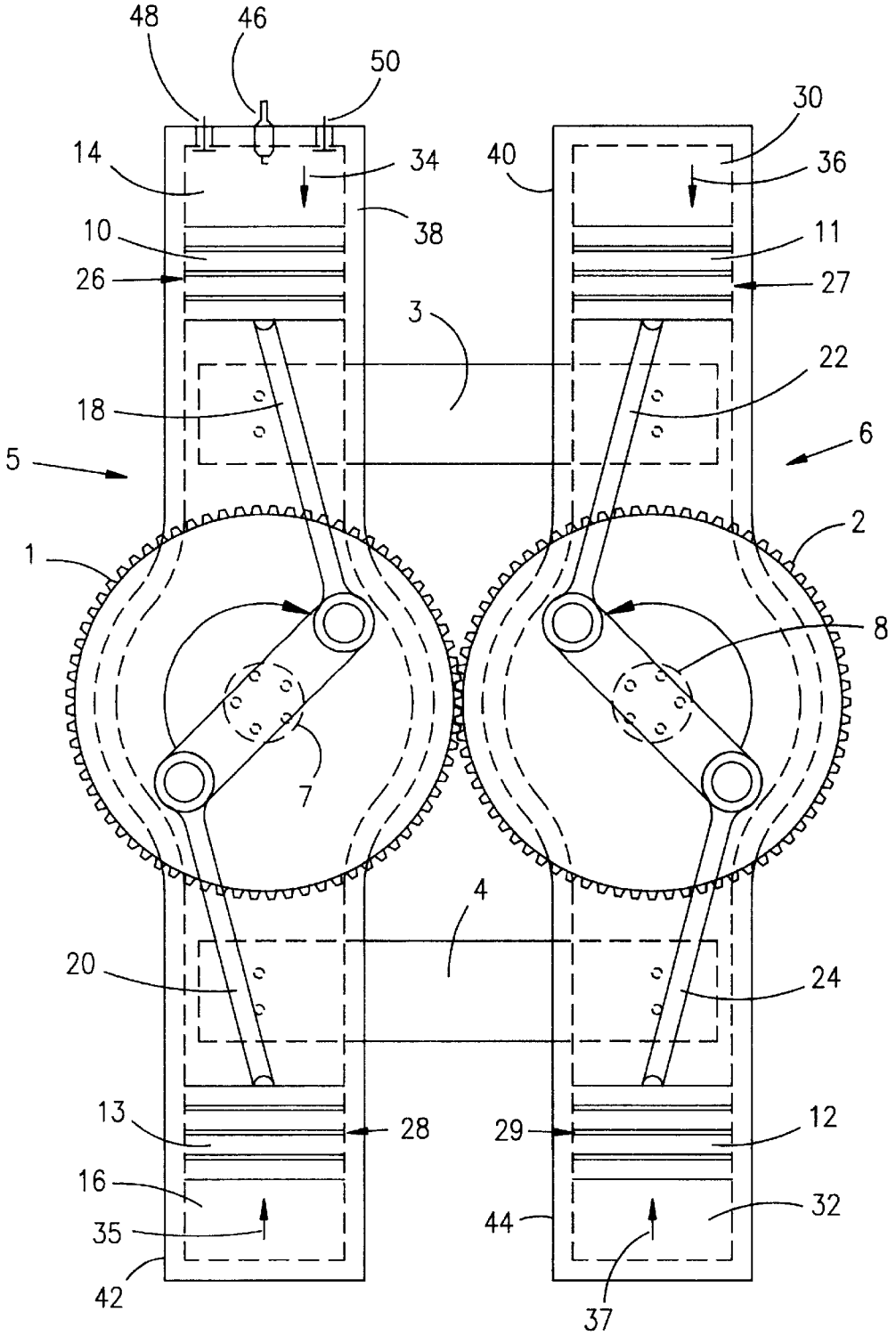
FIG. 2 is an end view, in cross-section, of the preferred embodiment of FIG. 1.

Referring now to FIG. 2. In the illustration, all four of the pistons 10, 11, 12 and 13 in the two engine subassemblies 5 and 6 are undergoing the power stroke or expansion phase of the combustion cycle as indicated by arrows 34–37. Cylinders 38, 40, 42 and 44 slidably receive, respectively, pistons 26, 27, 28 and 29, thus defining therein combustion chambers 14, 30, 16 and 32. Combustion products formed in combustion chambers 14 and 16 exert force on pistons 10 and 13 and, through connecting rods 18 and 20, produce a torque rotating crankshaft 7 in a clockwise direction. Meanwhile, combustion products in combustion chambers 30 and 32 exert a similar force on pistons 11 and 12, forcing connecting rods 22 and 24 to create a similar torque for rotation of crankshaft 8 in a counter-clockwise direction. Gear wheels 1 and 2 are connected to their respective crankshafts and are enmeshed together to synchronize the speed of crankshafts 7 and 8 while enforcing their counter-rotation. In the illustration, crankshaft 7 rotates in a clockwise direction while crankshaft 8 rotates counterclockwise, but this choice is arbitrary and the rotations could be reversed.

Consider now the forces acting on the pistons, connecting rods, and cylinder walls during an arbitrary phase of the combustion cycle. Due to the rotation of the crankshafts 7 and 8, side forces such as illustrated by arrows 26, 27, 28 and 29 exist at the cylinder walls in directions and magnitudes that vary with progress of the combustion cycle. The directions and magnitudes of the force pair 27 and 26 and force pair 29 and 28 always oppose each other. If only one engine subassembly, perhaps subassembly 6, was present, the side forces 27 and 28 would tend to rotate the engine as torque is taken off its crankshaft to drive the vehicle, and this rotative tendency would have to be counteracted by the engine mounts. However, due to the presence of engine subassembly 5 rotating in an opposite direction on the same timing, the side forces 27 and 29 are counteracted by equal and opposite side forces 26 and 28. Since the pistons are timed identically and the crankshafts counter rotate, the pair of forces 26 and 27 and the pair 28 and 29 are always equal in magnitude and opposite in direction throughout all portions of the combustion cycle. Because the two engine subassemblies 5, 6, on which the force pairs act, are connected as a unit by braces 3 and 4 or other connecting means, the force pairs cancel each other and cannot result in movement of the engine, thereby relieving the engine mounts of such forces.

Each of the cylinders 38, 40, 42 and 44 has a head portion in which an igniting device 46, inlet valve 48, a fuel injector 46 and an exhaust valve 50 are mounted and provide their conventional functions.

Figure 3:
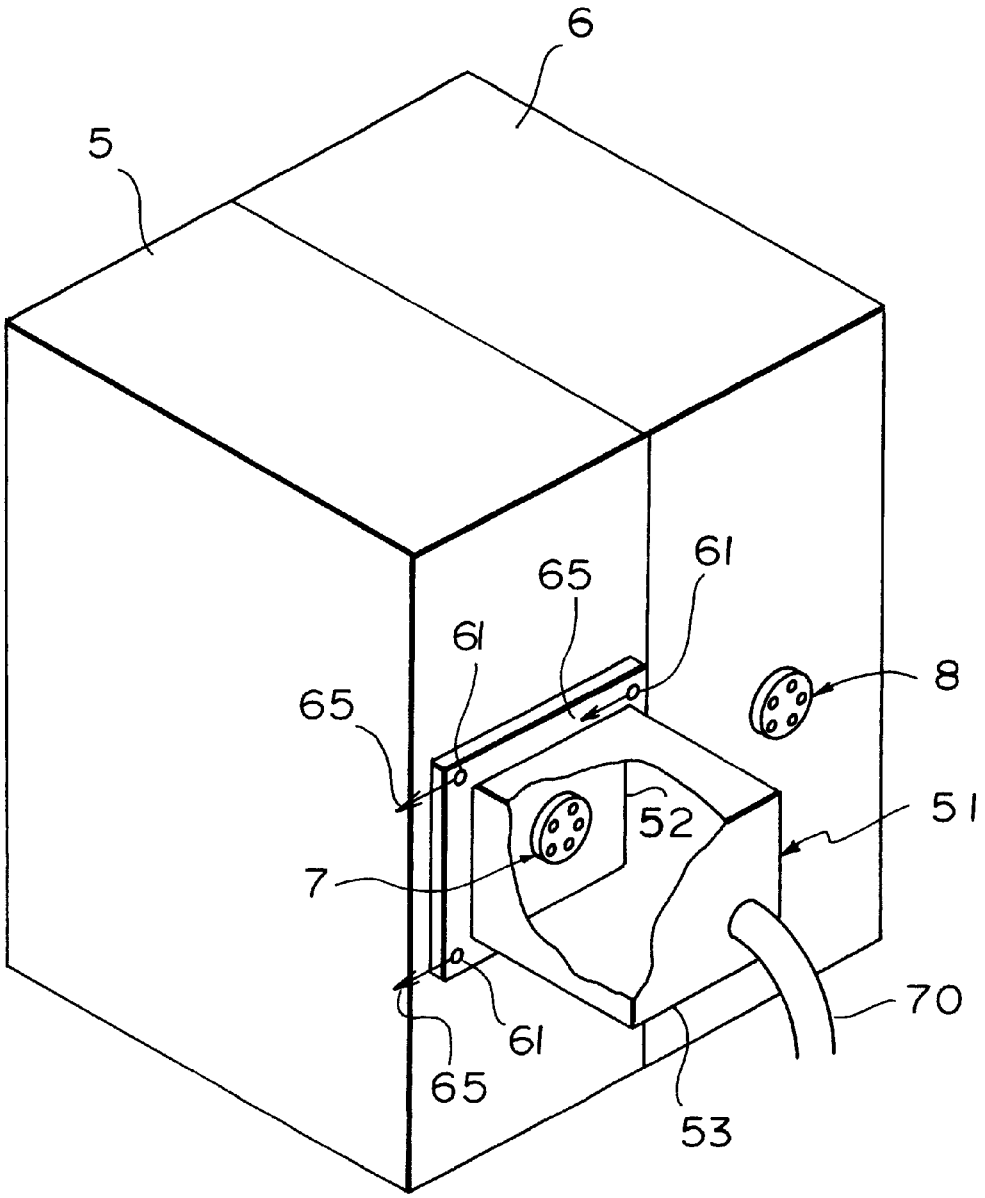
FIG. 3 is a perspective view of the engine inclusive of a power take-off device.

Due to the nature of the combustion cycle, cyclic variations in torque on the crankshafts may still exist. However, work may be performed by the crankshafts by mounting a fluid power pump or electric generator or other power take-off device entirely and directly to the housing of the engine as shown in perspective view of the preferred embodiment in FIG. 3. The housing 53 of a power take-off device 51 is shown enclosing crankshaft 7 and is attached directly and entirely to the engine by bolts 61. However, a power take-off device may utilize either or both of crankshafts 7 and 8 since the crankshafts are mechanically connected. The torque produced by the two engine subassemblies 5 and 6 is delivered to the power take-off device 51 ("power conversion means", e.g. electric generator) and the forces produced by said torque, as indicated by arrow 52 are reacted through the housing 53 of the power take-off device 51 and through bolts 61 to the engine housing, as indicated by arrows 65. Power is delivered from the power take-off device through conductive cable 70. With a fluid power pump as the power take-off device 51, the effects of cyclic torque variations present in the crankshaft and the act of capturing the crankshaft torque are dissipated within the engine/pump mounting interface rather than the engine mounts. All torque variations and vibration are thereby isolated within the engine/pump system and are not transmitted to the vehicle through the engine mounts.

The unique features of the engine of the present invention provide several advantages over other small engines that make it more practical for use in motor vehicles. Instead of relying on the engine mounts to absorb and transmit the inherent cyclic crankshaft torque variations as torque is taken off it to drive the vehicle, the problem is now limited to the mounting interface between the engine and the mounted pump or other device. Therefore, in a vehicle application, there is no chance of these forces being transmitted to the frame and resulting in unwanted vehicle vibration. This advantage allows the consideration of unusually slow engine speeds and small engines with high load factor without worrying about vehicle vibration. Many promising hybrid powertrain schemes call for a small engine operating at very slow speeds during some modes of operation. Since the effect of the peak-to-valley amplitude of the variation increases as the number of cylinders and the operating speed decreases, the potential for frame vibration has discouraged such hybrid powertrains. However, the present invention makes these schemes more practical.

Although the invention has been illustrated as having a pair of two-cylinder engine subassemblies, the engine subassemblies could also be single-cylinder or multiple-cylinder engines without departing from the spirit of the invention.

While the illustrated engine subassemblies are mechanically balanced, the invention would also work with mechanically unbalanced engine subassemblies. Naturally, the invention is not limited to a single pair of engine subassemblies, as the invention is also applicable to embodiments with multiple pairs.

The means for synchronizing likewise is not limited to the metal gear wheels illustrated, as it could be any equivalent means, for example a chain and sprocket system or a belt and pulley system or any number of other means.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An internal combustion engine comprising:

an engine housing;

at least first and second engine subassemblies housed within said engine housing for mounting to a vehicle chassis through engine mounts, each of said engine subassemblies comprising a crankshaft, at least one piston drivably connected to the crankshaft through a piston rod, and a combustion cylinder slidably receiving said one piston to define a combustion chamber therein;

synchronization means for mechanically linking the crankshafts of said subassemblies, to provide identical timing for one piston of each of said subassemblies and counter-rotation of said crankshafts; and a mechanical power conversion device for converting torque produced by said engine subassemblies into electrical or hydraulic power, said mechanical power conversion device being mounted on and entirely supported by said engine housing to prevent variations in the torque from being borne by the engine mounts.

2. The internal combustion engine of claim 1 wherein said synchronization means comprises a gear member on each crankshaft, said gear members being enmeshed together.

3. The internal combustion engine of claim 1 further comprising:

charge means for forming a combustible charge within each of said combustion chambers;

ignition means for igniting the combustible charge within each of said combustion chambers; and wherein said ignition means and said synchronization means provide simultaneous ignition of said combustible charges within all of said combustion chambers.

4. The internal combustion engine of claim 1 wherein each of said engine subassemblies comprises a pair of pistons linearly aligned on opposite sides of the crankshaft and a pair of combustion cylinders, respectively receiving said pair of pistons, linearly aligned on opposite sides of the crankshaft.

5. The internal combustion engine of claim 4 wherein said synchronization means comprises a gear member on each crankshaft, said gear members being enmeshed together.

6. The internal combustion engine of claim 4 further comprising:

charge means for forming a combustible charge within each of said combustion chambers;

ignition means for igniting the combustible charge within each of said combustion chambers; and wherein said ignition means and said synchronization means provide simultaneous ignition of said combustion charges within all of said combustion chambers.

* * * * *